US005711408A

United States Patent [19]

Dick

[11] Patent Number: 5,711,408

[45] Date of Patent: Jan. 27, 1998

[54] REVERSIBLE GEROTOR PUMP

[75] Inventor: Joseph A. Dick, Ft. Wayne, Ind.

[73] Assignee: Dana Corporation, Toledo, Ohio

[21] Appl. No.: 647,359

[22] Filed: May 9, 1996

[51] Int. Cl.[6] ..... F04C 2/10

[52] U.S. Cl. ..... 192/85 R; 418/61.3

[58] Field of Search ..... 192/85 R, 85 AT, 192/91 A; 418/32, 166, 61.3

[56] References Cited

U.S. PATENT DOCUMENTS

| | | | |
|---|---|---|---|
| 1,964,330 | 6/1934 | Pitt | 418/32 X |
| 3,118,387 | 1/1964 | Aldrich . | |
| 3,165,066 | 1/1965 | Phelps et al. . | |
| 4,171,192 | 10/1979 | Taylor et al. . | |

FOREIGN PATENT DOCUMENTS

| | | | |
|---|---|---|---|
| 2029905 | 3/1980 | United Kingdom | 418/32 |

*Primary Examiner*—Rodney H. Bonck
*Attorney, Agent, or Firm*—Oldham & Oldham Co., L.P.A.

[57] ABSTRACT

A reversible gerotor pump and a drivetrain subassembly including the reversible pump, wherein the pump includes inner and outer rotors located within an eccentric ring and also includes a drag spring mechanism, such as a band spring, positioned around and frictionally engaged with a portion of the outer rotor. Frictional engagement between the outer pump rotor and the band spring permits the outer pump rotor to apply a rotational force to the eccentric ring when the outer rotor reverses direction, thereby ensuring positive rotation of the eccentric ring 180° upon reversal of the pump. The spring may be a split-band spring having a free diameter which is smaller than the outer diameter of the outer rotor, and the eccentric ring preferably includes an ear projecting radially inwardly and positioned between the ends of the band spring. In this manner, rotation of the outer rotor and spring causes rotation of the eccentric ring through force applied on the eccentric ring at the ear. A stop pin is provided to limit rotation of the eccentric ring to 180° in either direction and, once the ring is restrained from further rotation by the stop pin, the pressure of the spring end on the ear causes the spring's diameter to slightly increase, thereby reducing wear on the outer diameter of the outer rotor.

20 Claims, 2 Drawing Sheets

REVERSIBLE GEROTOR PUMP

FIELD OF INVENTION

The present invention relates generally to a reversing gerotor pump for use in a drivetrain subassembly such as a differential or a torque transfer case, and also relates to a drivetrain subassembly including the reversing pump. The pump includes a drag spring mechanism mounted about the outer rotor of the pump to ensure positive rotation of the eccentric ring upon a change in the direction of rotation of the outer rotor of the pump.

BACKGROUND OF THE INVENTION

Gerotor pumps, and the reversing variety thereof, are generally well known and used in numerous automobile drivetrain subassembly applications. In general, the gerotor pump consists of two components—an inner rotor and an outer rotor. The inner rotor has one less tooth than the outer rotor and has a center line positioned at a fixed eccentricity from the center line of the outer element. All gerotor pumps share the basic principle of having one fewer tooth on the inner driving element. Conjugately generated tooth profiles maintain continuous fluid-tight contact between the inner and outer rotors during operation. As the gerotor revolves, liquid is drawn into an enlarging chamber formed by the missing tooth, to a maximum volume equal to that of the missing tooth on the inner element. The liquid is forced out as the teeth of the inner and outer rotors once again mesh, thereby decreasing the chamber volume. In certain applications, the gerotor pump may be configured wherein the outer rotor is connected to rotate with a first shaft and the inner rotor is connected to rotate with a second shaft. In such a configuration, no fluid will be displaced by the pump unless the first and second shafts are rotating at different speeds relative to one another, thereby causing differential rotation of the inner and outer rotors relative to one another.

A common application of gerotor pumps in drivetrain subassemblies involves utilizing the gerotor to provide fluid pressure to actuate a clutch assembly in response to differential rotation between rotating members. Gerotor pumps may also be used in drivetrain subassemblies to circulate lubricating fluid to the various components of the assembly. Gerotor pumps generally have an inlet port and an outlet port located approximately 180° relative to one another. When non-reversing gerotor pumps are utilized, a change in direction of rotation of the inner and outer rotors causes a reversal in the flow of fluid from the outlet port to the inlet port. In vehicular applications, it is desirable, therefore, to use a reversing gerotor pump such that a reversal in the direction of rotation of the rotors does not cause a reversal in the flow of fluid from the inlet port to the outlet port. This is accomplished by positioning the outer rotor within a free-turning eccentric ring. A stop pin is also provided and limits rotation of the eccentric ring to 180° in either direction. Changing the eccentricity of a gerotor pump in this manner, by allowing the eccentric ring to rotate 180°, also reverses the flow of fluid. Therefore, it can be seen that, if upon a reversal in direction of the gerotor pump the eccentric ring is caused to rotate 180°, the direction of fluid flow will remain unchanged, from inlet port to outlet port.

The rotation of the eccentric ring 180° in response to a change in direction of the gerotor pump is accomplished by frictional force between the outer rotor of the gerotor and the eccentric ring. A variety of mechanisms are known for increasing the friction between the outer rotor and the eccentric ring to ensure rotation of the eccentric ring upon reversal of the pump without excessive wear and drag upon the pump components. However, these know mechanisms are generally complex, require a number of different parts, and are difficult to assemble. Operation of known mechanisms also results in a large mount of wear when used in applications requiring frequent pump reversals, such as drivetrain subassembly applications.

SUMMARY OF THE INVENTION

The present invention is therefore directed to a reversible gerotor pump, including inner and outer rotors located within an eccentric ring. The pump also includes a drag spring mechanism positioned around and frictionally engaged with the outer rotor between the outer rotor and the eccentric ring. This frictional engagement between the outer pump rotor and the band permits the outer pump rotor to apply a rotational force to the eccentric ring when the outer rotor reverses direction, thereby ensuring positive rotation of the ring 180° upon reversal of the pump. The drag spring may be a split-band spring having a free diameter which is smaller than the outer diameter of the outer rotor, and the eccentric ring preferably includes an ear projecting radially inwardly and positioned between the ends of the band spring. In this manner, rotation of the outer rotor and spring causes rotation of the eccentric ring through force applied on the eccentric ring at the ear. A stop pin is provided to limit rotation of the eccentric ring to 180° in either direction and, once the ring is so rotated, pressure of the spring end on the ear causes the spring's diameter to slightly increase, thereby reducing wear on the outer diameter of the outer rotor.

DETAILED DESCRIPTION OF THE PREFERRED EMBODIMENT

Figure 1A:
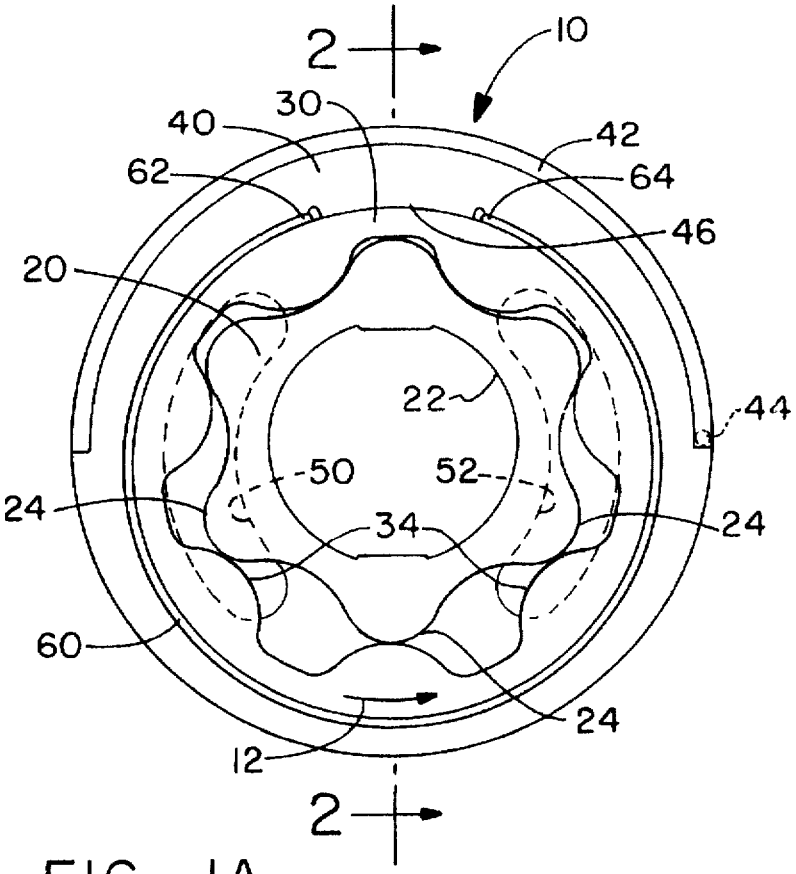
FIGS. 1A and 1B are from elevational views of a reversing gerotor pump in accordance with the present invention.

Reference will now be made in detail to the present preferred embodiments of the invention, examples of which are illustrated in the accompanying drawings. Wherever possible, the same reference numbers will be used throughout the drawings to refer to the same or like parts. A reversible gerotor pump in accordance with the present invention is indicated generally at 10 in FIGS. 1 and 2, and comprises an inner impeller or rotor 20, an outer impeller or rotor 30, and an eccentric ring 40. Inner rotor 20 includes a central aperture 22, allowing inner rotor to be positioned about and coupled to rotate with a shaft or the like, such as may be found in a four wheel drive transfer case, a differential, or any other drivetrain subassembly or other mechanism. Eccentric ring 40 is ordinarily positioned within a pump housing (not shown) which includes a stop pin (shown in phantom at 44 in FIGS. 1A and 1B) projecting therefrom into a 180° groove 42 formed in the eccentric ring 40. In this manner, the rotation of the eccentric ring within the pump housing is limited to 180° as is required during pump reversals, discussed in further detail below. Outer rotor 30 is rotatably positioned within eccentric ring 40 (and usually coupled to rotate with the pump housing) and includes a plurality of internal lobes or teeth 34. Inner rotor 20 includes a plurality of external lobes or teeth 24 which are provided one less in number than the number of internal teeth 34 of outer rotor. In this manner, external teeth 24 of inner rotor 20 are engaged with only a portion of internal teeth 34 of outer rotor 30 at any moment. Rotation of the inner rotor 20, which causes rotation of the outer rotor 30 within eccentric ring 40, thus provides a series of variable volume chambers between the teeth 24,34 of the inner and outer rotors 20,30, respectively. Rotation of the inner and outer rotors 20,30 causes fluid to be drawn into the enlarging chamber formed between the teeth 24,34 and results in the fluid being forced from the chamber as the teeth 24,34 converge.

An inlet port 50 is provided and may be connected through tubing or another suitable conduit to a sump or the like containing a quantity of fluid. Likewise, an outlet port 52 is provided and may be in fluid communication with a hydraulic piston for the actuation thereof, or may be in communication with a conduit or channel to deliver the fluid to other components. In this manner, fluid may be drawn into the pump 10 through the inlet port 50 and expelled therefrom under pressure through port 52. Those skilled in the art will recognize that unless the pump 10 is of the reversible variety, a reversal in the direction of rotation of the rotors 20,30 will cause the direction of the fluid flow to reverse—i.e., fluid will be drawn into the outlet port 52 and expelled from the inlet port 50. For many applications, this is an undesirable result, such as where pump 10 is utilized to provide pressurized hydraulic fluid to actuate a hydromechanical assembly or to ensure the proper circulation of a fluid lubricant. In these and other applications, the pump must operate to pump fluid in a single direction, regardless of the reversal of rotors 20,30.

Figure 2:
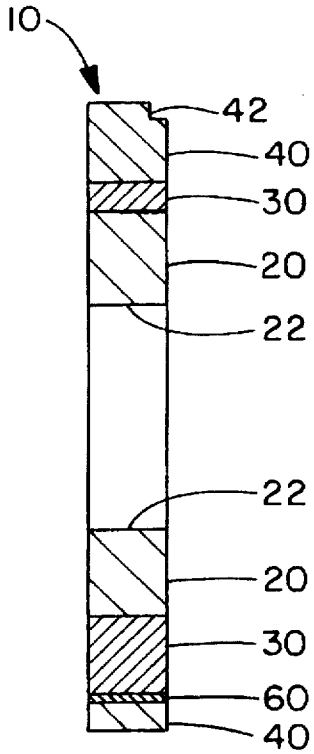
FIG. 2 is a cross-sectional view along line 2—2 of FIG. 1A.
Figure 1B:
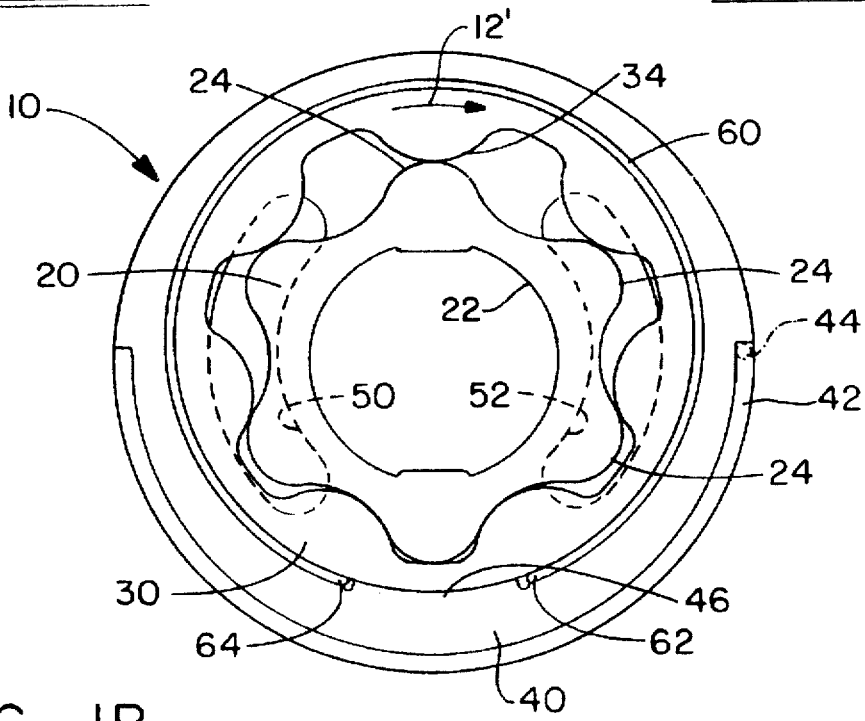

A reversible gerotor pump is a pump that avoids the above-noted problems caused by a reversal in direction of rotation of the inner and outer rotors. FIG. 1A shows a reversible pump 10 with the outer rotor 30 thereof rotating in a first direction (indicated by arrow 12) such that fluid will be drawn into pump 10 through inlet port 50 and expelled through outlet port 52. Despite the rotation of the outer rotor as indicated, the eccentric ring is restrained from rotation due to the engagement of stop pin 44 and an end of groove 42. Upon a reversal of direction of rotation of the inner and outer rotors 20,30, as is shown in FIG. 1B and indicated by arrow 12', the eccentric ring 40 will rotate 180° in response to friction between the outer rotor 30 and the eccentric ring 40 (discussed in more detail below), until the opposite end of groove 42 engages stop pin 44. Rotation of the eccentric ring changes the eccentricity of the pump such that the teeth 24,34 of the inner and outer rotors 20,30, respectively, engage one another at the lower portion of pump 10, rather than at the upper portion of pump 10 as is shown in FIG. 1A. It can be seen this change in eccentricity allows the fluid to continue to be drawn into the expanding chambers at the inlet port 50 and expelled from the contracting chambers at the outlet port 52, rather than reversing direction, despite the change in the direction of rotation of the pump 10. Reversible gerotor pumps have numerous applications in automotive drivetrain subassemblies, such is described in detail in co-pending and commonly assigned U.S. patent applications 08/543,173 filed Oct. 13, 1995 and 08/430,503 filed Apr. 28, 1995, and now U.S. Pat. No. 5,655,983, both of which patent applications are expressly incorporated by reference herein.

In drivetrain subassemblies and other applications involving frequent pump reversals, it is not uncommon with pumps heretofore known, that upon a reversal in direction of the pump, the friction between the outer rotor and the eccentric ring is not sufficient to rotate the eccentric ring 180° as is required to ensure fluid flow from the inlet port to the outlet port, which results in the problems discussed above. It is generally difficult to establish and maintain the proper amount of friction between the outer rotor and the eccentric ring to ensure rotation of the eccentric ring upon reversal of the pump without creating an undue amount of friction which will cause the pump to wear excessively.

Figure 3:
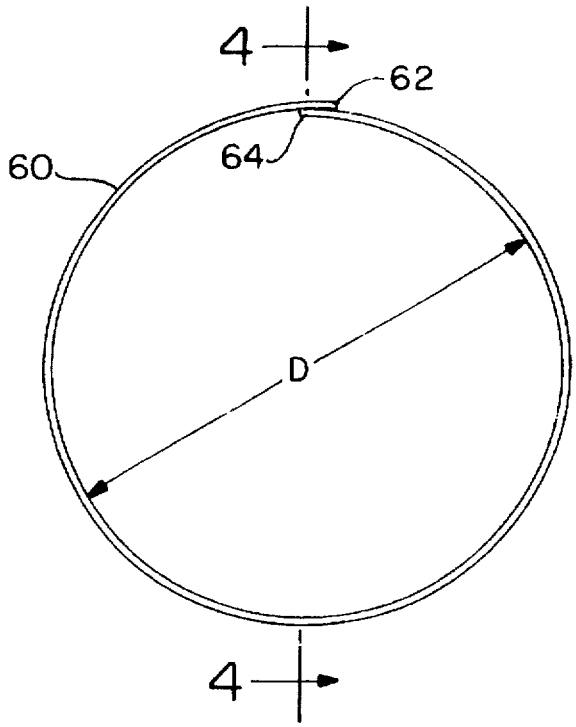
FIG. 3 is front elevational view of a drag-spring in accordance with the present invention.
Figure 4:
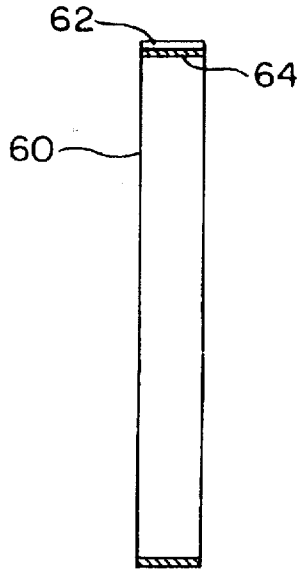
FIG. 4 is a cross-sectional view of the spring shown in FIG. 3 along line 4—4 thereof.
Figure 5:
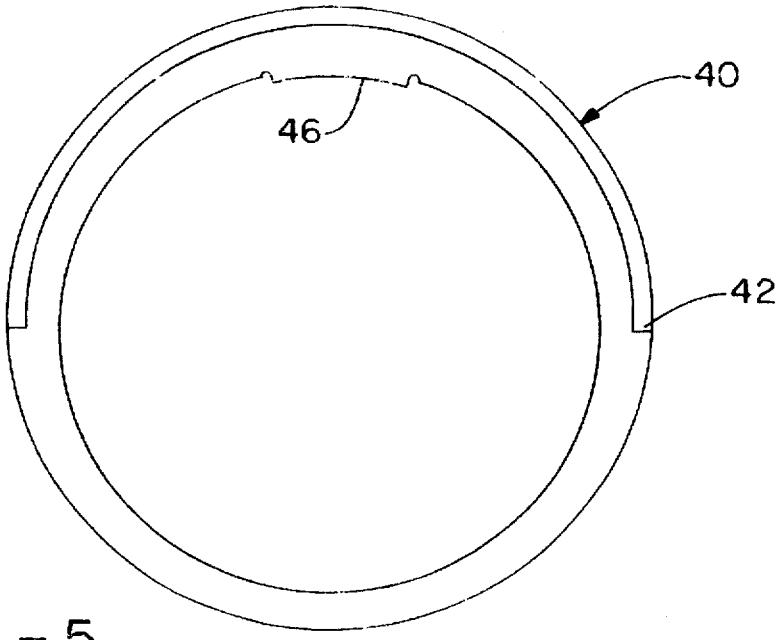
FIG. 5 is a front elevational view of an eccentric ring suitable for use in the pump of the present invention.

The reversible gerotor pump 10 in accordance with the present invention provides an effective mechanism whereby, upon reversal of the pump 10, rotation of the eccentric ring is ensured, without creating excessive wear on the pump components. Specifically, a pump 10 in accordance with the present invention comprises a drag spring 60 positioned around and frictionally engaged with the outer diameter or periphery of the outer rotor 30. As may be seen most clearly in FIGS. 3–4, drag spring 60 is preferably provided in the form of a band spring having a free inner diameter D (FIG. 3) which is smaller than the outer diameter of the outer pump rotor 30. Therefore, spring 60 must be stretched to fit on the outer diameter of the outer rotor 30, and, once it is positioned thereon, spring 60 frictionally engages the outer rotor to rotate therewith. Spring 60 is preferably made from steel or another metal, but may alternatively be made from a wide variety of polymeric materials. In the preferred embodiment shown herein, spring 60 is provided in the form of a split band spring having ends 62,64 that become separated a short distance when spring 60 is positioned about the outer rotor as described. The eccentric ring 40 (seen most clearly in FIG. 5) includes an ear 46 projecting radially inward therefrom. In the preferred embodiment, ear 46 is positioned between the ends 62,64 of spring 60 when the pump is assembled as is shown in FIGS. 1A and 1B. In this manner, any rotation of outer rotor 30 causes one of ends 62,64 of spring 60 to engage ear 46 and exert a rotational force on eccentric ring 40, thereby ensuring its rotation through 180° when pump 10 reverses. Once eccentric ring is restrained from further rotation by stop-pin 44, the spring 60 is likewise restrained from further rotation with the outer rotor 30 due to the engagement of the spring and the ear 46 of the eccentric ring. This causes the outer rotor 30 to rotate within the spring 60. Once the eccentric ring 40 and the spring 60 are restrained from further rotation, the force of one of the ends 62,64 of spring 60 against ear 46 causes the diameter of the spring 60 to enlarge a small amount, thereby preventing excessive friction between the outer rotor 30 and the spring 60.

Those skilled in the art will recognize that the foregoing description has set forth the preferred embodiment of the invention in particular detail and it must be understood that numerous modifications, substitutions and changes can be undertaken without departing from the true spirit and scope of the present invention as defined by the ensuing claims.

What is claimed is:

1. A reversible gerotor pump apparatus, comprising:

an eccentric ring;

an outer rotor positioned within said eccentric ring, said outer rotor including a plurality of internal teeth;

an inner rotor including a plurality of external teeth, wherein at least a portion of said internal teeth of said outer rotor are engaged with at least a portion of said external teeth of said inner rotor, such that said inner rotor and said outer rotor are eccentric relative to one another; and a drag spring positioned around and frictionally engaged with at least a portion of said outer rotor such that said drag spring exerts a force on said eccentric ring only upon rotation of said outer rotor.

2. The reversible gerotor pump apparatus as recited in claim 1, wherein said eccentric ring includes an ear projecting radially inwardly therefrom and said drag spring exerts a rotational force on said eccentric ring through said ear.

3. The reversible gerotor pump apparatus as recited in claim 2, wherein said drag spring is a split band spring having a first end and a second end and said ear of said eccentric ring is positioned between said first end and said second end.

4. The reversible gerotor pump apparatus as recited in claim 3, wherein said split band spring substantially surrounds said outer rotor.

5. The reversible gerotor pump apparatus as recited in claim 3, wherein said outer rotor has an outer diameter and said split band spring has a free diameter smaller than said outer diameter of said outer rotor such that said split band spring is frictionally engaged with said outer rotor.

6. The reversible gerotor pump apparatus as recited in claim 3, wherein said split band spring is metallic.

7. The reversible gerotor pump apparatus as recited in claim 3, wherein said split band spring is polymeric.

8. A reversible gerotor pump apparatus for use in a motor vehicle drivetrain subassembly having a first rotatable member, a second rotatable member and a hydraulically actuated clutch assembly to selectively frictionally couple the first rotatable member and the second rotatable member, said reversible gerotor pump comprising:

an eccentric ring;

an outer rotor positioned within said eccentric ring, said outer rotor including a plurality of internal teeth;

an inner rotor including a plurality of external teeth meshingly engaged with at least a portion of said internal teeth of said outer rotor, said inner rotor coupled to rotate with one of the first rotatable member and the second rotatable member; and a drag spring positioned around and frictionally engaged with at least a portion of said outer rotor such that said drag spring exerts a force on said eccentric ring only upon rotation of said outer rotor.

9. The reversible gerotor pump apparatus as recited in claim 8, wherein said eccentric ring includes an ear projecting radially inwardly therefrom and said drag spring exerts a rotational force on said eccentric ring through said ear.

10. The reversible gerotor pump apparatus as recited in claim 9, wherein said drag spring is a split band spring having a first end and a second end and said ear of said eccentric ring is positioned between said first end and said second end.

11. The reversible gerotor pump apparatus as recited in claim 10, wherein said split band spring substantially surrounds said outer rotor.

12. The reversible gerotor pump apparatus as recited in claim 10, wherein said outer rotor has an outer diameter and said split band spring has a free diameter smaller than said outer diameter of said outer rotor such that said split band spring is frictionally engaged with said outer rotor.

13. The reversible gerotor pump apparatus as recited in claim 10, wherein said split band spring is metallic.

14. The reversible gerotor pump apparatus as recited in claim 10, wherein said split band spring is polymeric.

15. A reversible gerotor pump apparatus, comprising:

an eccentric ring;

an outer rotor positioned within said eccentric ring, said outer rotor including a plurality of internal teeth;

an inner rotor including a plurality of external teeth, wherein at least a portion of said internal teeth of said outer rotor are engaged with at least a portion of said external teeth of said inner rotor, such that said inner rotor and said outer rotor are eccentric relative to one another; and a band spring substantially surrounding said outer rotor and frictionally engaged with at least a portion of said outer rotor such that said band spring exerts a rotational force on said eccentric ring in response to rotation of said outer rotor.

16. The reversible gerotor pump apparatus as recited in claim 15, wherein said eccentric ring includes an ear projecting radially inwardly therefrom and said band spring exerts a rotational force on said eccentric ring through said ear.

17. The reversible gerotor pump apparatus as recited in claim 16, wherein said band spring is a split band spring having a first end and a second end and said ear of said eccentric ring is positioned between said first end and said second end.

18. The reversible gerotor pump apparatus as recited in claim 17, wherein said outer rotor has an outer diameter and said split band spring has a free diameter smaller than said outer diameter of said outer rotor such that said split band spring is frictionally engaged with said outer rotor.

19. The reversible gerotor pump apparatus as recited in claim 17, wherein said split band spring is metallic.

20. The reversible gerotor pump apparatus as recited in claim 17, wherein said split band spring is polymeric.

* * * * *